United States Patent [19]

McCarn

[11] 4,421,231

[45] Dec. 20, 1983

[54] DISPLAY AND STORAGE PACKAGE FOR AN ELONGATED FLAT ARTICLE

[75] Inventor: Ellen D. McCarn, Birmingham, Ala.

[73] Assignee: McCarn Enterprises, Inc., Birmingham, Ala.

[21] Appl. No.: 421,881

[22] Filed: Sep. 23, 1982

[51] Int. Cl.[3] ..... B65D 85/00; B65H 54/46; B65H 55/00

[52] U.S. Cl. ..... 206/388; 206/455; 206/456

[58] Field of Search ..... 206/388, 44 B, 44.11, 206/578, 225, 232, 309, 311, 312, 455, 456

[56] References Cited

U.S. PATENT DOCUMENTS

| | | | |
|---|---|---|---|
| 1,598,101 | 8/1926 | Newman | 206/388 |
| 2,043,118 | 6/1936 | Protz | 206/388 |
| 2,968,882 | 1/1961 | Ozeki | 206/456 |
| 3,719,970 | 3/1973 | Carlson | 206/455 |
| 3,756,393 | 9/1973 | Markwitz et al. | 206/456 |
| 3,869,044 | 3/1975 | Olsson et al. | 206/388 |

FOREIGN PATENT DOCUMENTS

| | | | |
|---|---|---|---|
| 1117031 | 2/1956 | France | 206/455 |
| 470230 | 3/1952 | Italy | 206/456 |

*Primary Examiner*—Joseph Man-Fu Moy
*Attorney, Agent, or Firm*—Woodford R. Thompson, Jr.

[57] ABSTRACT

A display and storage package for an elongated flat article embodies a generally rectangular pocket defined by superimposed flexible sheets of a width greater than the width of the elongated article. The flexible sheets are joined to each other along spaced apart, longitudinal side edges and along one end edge, with the other end of the pocket being open for receiving the elongated article. An intermediate projection extends inwardly from one longitudinal side of the pocket and longitudinally spaced end projections extend inwardly from the other longitudinal sides of the pocket. The projections are so positioned relative to each other that the elongated article is movable inwardly of the intermediate projection as one end of the elongated article is moved inwardly relative to its end projection and the other end of the elongated article is moved outwardly relative to its end projection.

4 Claims, 4 Drawing Figures

DISPLAY AND STORAGE PACKAGE FOR AN ELONGATED FLAT ARTICLE

BACKGROUND OF THE INVENTION

This invention relates to a display and/or storage package for an elongated flat article, such as a thread and yarn organizer which is employed for holding a flexible strand of yarn or thread of indeterminate length. Such a thread and yarn organizer is disclosed in my U.S. Pat. No. Des. D-265,863 dated Aug. 24, 1982.

Heretofore in the art to which my invention relates, difficulties have been encountered in storing and/or displaying for sale elongated flat articles, such as thread and yarn organizers, due to the fact that no positive means has been employed heretofore to retain the elongated flat articles within the display device carrying the same. Accordingly, such elongated flat articles fall out of their display devices as they are handled. While such elongated flat articles have been displayed within packages which are sealed around the entire article, such packages are objectionable due to the fact that the article cannot be removed from its package for inspection.

SUMMARY OF THE INVENTION

In accordance with my invention, I overcome the above and other difficulties by providing a display and storage package for an elongated flat article, such as a thread and yarn organizer, by providing an elongated, generally rectangular pocket-like member which is defined by superimposed flexible sheets of a width greater than the width of the elongated flat article to be displayed. The flexible sheets are joined to each other along spaced apart, longitudinal side edges and along one end edge, thus leaving the other end of the pocket-like member open for receiving the elongated flat article to be displayed or stored. The elongated flat article is releasably held within the pocket-like member by an intermediate projection which extends inwardly from one longitudinal side of the pocket-like member and longitudinally spaced end projections which extend inwardly from the other longitudinal side of the pocket-like member. The intermediate and end projections are so positioned that the elongated, flat article to be displayed or stored may be moved inwardly of the intermediate projection as one end of the elongated flat article is moved inwardly relative to the end projection adjacent thereto and the other end of the elongated flat article is moved outwardly relative to the end projection adjacent thereto. Accordingly, each end projection engages the end of the elongated, flat article adjacent thereto with a sliding, friction fit. This arrangement permits easy insertion of the elongated flat article into the pocket whereby it is releasably held within the pocket. Also, the elongated flat article may be readily removed from the pocket by merely moving the outermost end of the article laterally and inwardly of the free end of its end projection whereupon the elongated article may be removed from the pocket as the innermost end of the elongated article moves laterally and outwardly away from the free end of its end projection. The intermediate projection thus serves as a fulcrum point about which the elongated flat article pivots or turns as it moves into or out of the elongated pocket.

DESCRIPTION OF THE DRAWING

A display and storage package embodying features of my invention is shown in the accompanying drawing, forming a part of this application, in which.

DETAILED DESCRIPTION

Figure 1:
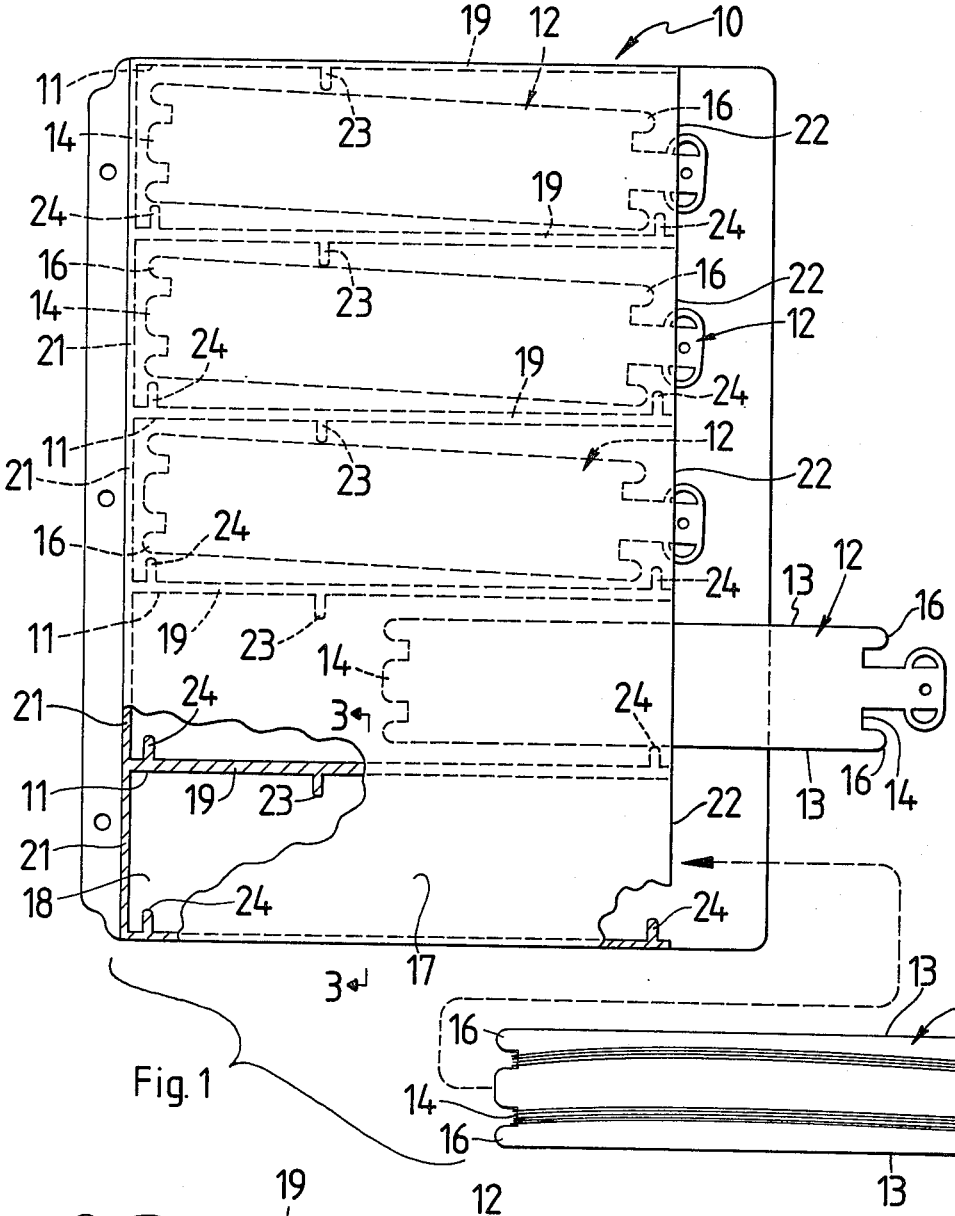
FIG. 1 is a top plan, exploded view, partly broken away and in section showing one elongated flat article having yarn wound thereon and removed from the package, with the other elongated flat articles being shown without the yarn wound thereon.

Referring now to the drawing for a better understanding of my invention, my improved display and storage package 10 is shown as comprising a plurality of generally rectangular pocket-like members 11 with each being adapted to receive an elongated, flat article 12. While I have shown the elongated flat article 12 as being in the form of a thread and yarn organizer, it will be apparent that the elongated flat article could be articles adapted for other uses. In FIG. 1, the elongated flat article 12 is shown as carrying a flexible strand of yarn of indeterminate length with the yarn being wound thereon, as shown.

Figure 2:
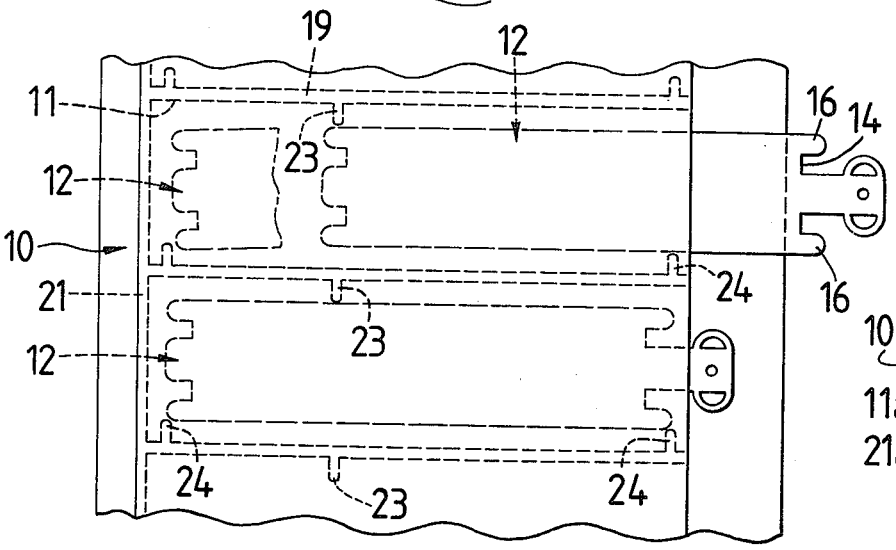
FIG. 2 is a fragmental view corresponding to FIG. 1 showing various positions of the elongated flat article relative to the display and storage package.

As shown in FIGS. 1 and 2, the elongated flat article 12 has spaced apart longitudinal extending side edges 13 extending generally parallel to each other and formed integrally with end edges 14. The point of juncture between adjacent side edges 13 and end edges 14 are rounded as at 16. While I have shown the end edges 14 as being irregular in shape, it will be apparent that the end edges could be of other shapes, such as a straight line.

Figure 3:
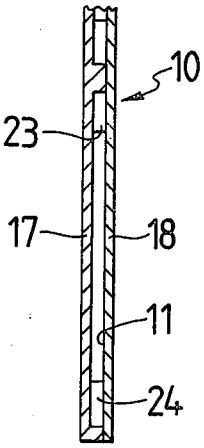
FIG. 3 is an enlarged sectional view taken generally along the line 3—3 of FIG. 1.

The display and storage package shown in FIGS. 1–3 is formed by heat sealing predetermined areas of superimposed, flexible sheets 17 and 18 to provide a plurality of rectangular pocket-like members 11 with each pocket 11 being of a width greater than the width of the elongated flat article 12. That is, the superimposed sheets 17 and 18 are heat sealed along spaced apart, parallel lines 19 to define side edges for each pocket-like member 11. Also, the superimposed flexible sheets 17 and 18 are heat sealed along one end of each pocket-like member 11 as it 21 to define one end edge for each pocket 11. The other end 22 of each pocket-like member 11 is open, as shown in FIG. 1, for receiving the elongated flat article 12. The flexible sheets 17 and 18 may be formed of a suitable thermoplastic plastic material which may be heat sealed to each other by conventional means well known in the art to which my invention relates.

An intermediate projection 23 extends inwardly of the pocket-like member 11 from one longitudinal side 19 thereof at a location nearer the end 21 of the pocket-like member 11 than the other end 22, as clearly shown in FIGS. 1 and 2. The projections 23 are formed by heat sealing the two superimposed sheets 17 and 18 to each other, as shown.

The superimposed flexible sheets 17 and 18 are also heat sealed to each other to provide longitudinally spaced end projections 24 which extend inwardly from the other longitudinal side of the pocket-like member 11. That is, the end projections 24 are provided along the longitudinal edge of each pocket 11 opposite the longitudinal edge which carries the intermediate projection 23. The end projections 24 are spaced longitudinally from each other and are positioned at opposite sides of the intermediate projection 23. The end projections are also spaced from each other a distance substantially equal the distance between the point of juncture 16 of the side edges 13 with the end edges 14 of the elongated article 12. The intermediate projection 23 being positioned between the end projections 24 extends inwardly a distance to engage the adjacent longitudinal edge 13 of the article 12 whereby the article 12 is adapted to pass inwardly of the intermediate projection 23 as one end 14 of the elongated flat article 12 is moved relative to the end projection 24 adjacent thereto and as the other end 14 of the elongated flat article 12 is moved outwardly relative to the end projection 12 adjacent thereto. This movement of the elongated flat article 12 is clearly illustrated in FIG. 1 relative to the three uppermost pocket-like members 11. That is, as the elongated article 12 is moved toward the left, as viewed in FIG. 1, the article 12 passes inwardly of the projection 23 as one end 14 of the flat article 12 is moved inwardly relative to the end projection 24 adjacent thereto. At the same time, the other end 14 of the article 12 is moved outwardly relative to the end projection 24 adjacent thereto. Accordingly, the elongated flat article 12 is releasably retained within the pocket 11 until the article 12 is moved toward the right whereupon it is easily removed from the pocket 11. By providing the rounded areas 16 at the point of juncture between the side edges 13 and end edges 14 of the elongated article 12, movement of the end of the elongated flat article 12 relative to the end projections 24 is greatly facilitated.

It will be understood that as the elongated flat article 12 is moved toward the right for removal from the pocket 11, the rounded edge 16 at the right side of FIG. 1 would then engage the adjacent end projection 24 whereupon that end of the article 12 would move inwardly and above its end projection 24, as viewed in FIG. 1. At the same time, the rounded end edge 16 of the elongated article 12 at the left side of FIG. 1 would then move outwardly or downwardly, as viewed in FIG. 1, as the article 12 is removed from its pocket.

Preferably, the longitudinal distance between the end projections 24 is at least as great as the distance between the points of juncture 16 of the side edges 13 and end edges 14 of the elongated flat article 12. Also, while I have shown a plurality of pockets 11 formed between a pair of superimposed flexible sheets 17 and 18, it will be apparent that one or more such pockets may be formed between superimposed sheets of flexible material.

Figure 4:
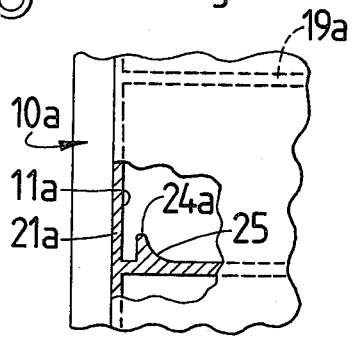
FIG. 4 is a fragmental, sectional view showing a modified form of my invention.

In FIG. 4 of the drawing, I show a slightly modified form of my invention in which a package **10*a*** is provided with pockets ll*a* as described above. That is, each pocket ll*a* is provided with spaced apart, longitudinally extending side edges **19*a* and end edge 21*a* adjacent one end of the pocket with the other end of the pocket being open for receiving the elongated article 12, as described above. To further facilitate movement of the adjacent end of the elongated flat article 12 relative to its end projection, I provide an end projection 24*a* having an arcuate surface 25 which is adapted to engage the rounded edge of the elongated article 12. That is, as the end of the article 12 is moved toward its end projection 24*a*, it engages the arcuate surface 25 which causes that end of the article 12 to move inwardly of the pocket relative to the end projection 24*a***.

From the foregoing, it will be seen that I have devised an improved display and storage package for an elongated flat article. By providing releasable means for retaining the elongated flat article within the pocket during display, I eliminate the chances of the article falling out of the pocket during normal handling of the package. Also, by providing a display package wherein the article may be readily removed therefrom by merely exerting sufficient force to move the leading end of the elongated article 12 past the end projection 24 adjacent thereto, the article may be removed from and then returned to its package.

While I have shown my invention in two forms, it will be obvious to those skilled in the art that it is not so limited, but is susceptible of various other changes and modifications without departing from the spirit thereof.

What I claim is:

1. In a display and storage package for an elongated flat article having spaced apart longitudinally extending side edges extending generally parallel to each other and formed integrally with end edges with the point of juncture between adjacent side edges and end edges being rounded, (a) at least one elongated, generally rectangular pocket-like member defined by superimposed flexible sheets of a width greater than the width of said elongated flat article and joined to each other along spaced apart longitudinal side edges and along one end edge with the other end of said pocket-like member being open for receiving said elongated flat article, (b) an intermediate projection extending inwardly of said pocket-like member from one longitudinal side thereof at a location nearer said one end of said pocket-like member than said other end thereof, and (c) longitudinally spaced end projections extending inwardly from the other longitudinal side of said pocket-like member at opposite sides of said intermediate projection and spaced from each other a distance substantially equal the distance between the points of juncture of said side edges with said end edges of said elongated flat article.

2. A display and storage package as defined in claim 1 in which said intermediate projection is at a location for said elongated flat article to pass inwardly thereof as one end of said elongated flat article is moved inwardly relative to the end projection adjacent thereto and the other end of said elongated flat article is moved outwardly relative to the end projection adjacent thereto.

3. A display and storage package as defined in claim 1 in which the longitudinal distance between said end projections is at least as great as the distance between the points of juncture of said side edges and end edges of said elongated flat article.

4. A display and storage package as defined in claim 1 in which a plurality of said elongated, flat pocket-like members are formed between a pair of superimposed flexible sheets of material.

* * * * *